US007412787B2

(12) United States Patent
Sutton et al.

(10) Patent No.: US 7,412,787 B2
(45) Date of Patent: Aug. 19, 2008

(54) SNOW MOVING APPARATUS

(76) Inventors: Keith R. Sutton, 809 Whitney Rd., Ontario, NY (US) 14519; Randall Sutton, 809 Whitney Rd., Ontario, NY (US) 14519

( * ) Notice: Subject to any disclaimer, the term of this patent is extended or adjusted under 35 U.S.C. 154(b) by 589 days.

(21) Appl. No.: 11/054,405

(22) Filed: Feb. 9, 2005

(65) Prior Publication Data

US 2005/0193597 A1 Sep. 8, 2005

Related U.S. Application Data

(60) Provisional application No. 60/543,220, filed on Feb. 10, 2004.

(51) Int. Cl.
*E01H 5/06* (2006.01)

(52) U.S. Cl. ..... 37/267; 37/449

(58) Field of Classification Search ..... 37/267, 37/449

See application file for complete search history.

(56) References Cited

U.S. PATENT DOCUMENTS

| | | | | |
|---|---|---|---|---|
| 3,896,568 | A * | 7/1975 | Hancock | 37/449 |
| 4,907,357 | A * | 3/1990 | Lilienthal | 37/197 |
| 6,314,666 | B1 * | 11/2001 | Klemenhagen et al. | 37/267 |
| 6,470,604 | B1 | 10/2002 | Foster et al. | |
| 6,817,118 | B2 * | 11/2004 | Schmeichel | 37/232 |

* cited by examiner

*Primary Examiner*—Thomas A Beach
(74) *Attorney, Agent, or Firm*—Jaeckle Fleischmann & Mugel, LLP

(57) ABSTRACT

An improved snow moving apparatus has a semi-cylindrical body and side plates that form an inner cavity that is impermeable by snow. The apparatus has a pushing scraper and a pulling scraper. The pushing scraper is in contact with the ground when the apparatus is in pushing mode and the pulling scraper is in contact with the ground with the apparatus is in pulling mode. The scrapers are adjustably attached to either the side plates or the body or both so that the level of the scrapers can be easily adjusted when the blades wear down through use.

1 Claim, 6 Drawing Sheets

SNOW MOVING APPARATUS

CROSS-REFERENCE TO RELATED APPLICATION

This application claims the benefit of U.S. provisional application No. 60/543,200 filed Feb. 10, 2004, the entire disclosure of which is incorporated by referenced in its entirety for any and all purposes.

BACKGROUND OF THE INVENTION

Conventional snow plows are well known for removing snow from various surfaces as needed. Generally, snowplows are mounted on the front end of a vehicle and could be used to either push or pull snow.

Currently snow plows are inefficient at removing snow residing in close proximity to buildings or other permanent structures. In operation, snowplows generally push the snow toward the building, where the snow sits in a pile. This is often troublesome in the case of driveways leading to garages as the pile of snow tends to build up in front of the garage door, making passage to and from garage difficult.

To overcome this problem, the plow operator may push the pile of snow toward the garage, and then lift the plow blade, placing the edge behind the newly formed snow pile, and drive away from the garage, pulling the snow with it. When pulling the snow back, the accumulated snow tends to escape either or both sides of the plow blade, thereby forming undesired accumulations of snow.

Snowplows with side plates have been developed to prevent the aforementioned problem relating to snow escaping from either side of the plow blades; however such devices are not capable of pulling snow. Generally, the side plates are attached to either or both sides of the plow blade and provide a means for containing the snow that would escape either side of the plow blade. While such devices are adequate for either pushing or pulling snow, depending on the direction of the void between the plates, they are unable to accomplish both.

U.S. Pat. No. 6,470,604 discloses a snow moving apparatus with side plates that can both push and pull snow. However, since the disclosed device merely comprises a pull blade bolted onto a typical snowplow with sides, a substantial amount of snow passes between the pull blade and the plow when snow is being pulled.

Furthermore, prior art snow removal devices typically have a scraping means, wherein said scraping means is generally in communication with the ground. The scrapers are typically formed of rubber or any suitable material and tend to wear after a period of usage. Rather than replace the entire scraper, currently the device is removed from the plow and the remaining rubber section is advanced through a support means. This process requires a great amount of time and labor to remove the scraper, feed the rubber section through the support means, and mount again to the unit. This process generally takes over three hours and usually must be performed outdoors in cold and snowy conditions.

Therefore, what is needed in the art is a snow removal apparatus capable of both pushing and pulling snow.

Furthermore, what is needed in the art is a snow removal apparatus capable of both pushing and pulling snow that efficiently clears the designated area by forming a solid barrier about the snow being pulled.

Moreover, what is needed in the art is such a snow moving device that further comprises a means for easily adjusting the scraper portion of the device.

SUMMARY OF THE INVENTION

An improved snow removal apparatus comprises a body member having an inner wall and a pair of side plates attached to the body member. The pair of side plates and the inner wall of the body form an inner cavity. A first scraper and a second scraper are attached to the body member. The first scraper is configured for engaging the ground when pushing snow and the second scraper is configured for engaging the ground when pulling snow. The first and second scrapers, the side plates and the body form a structure that is substantially impermeable by snow. The scrapers can be integral with the body member. The body member can be substantially semi-cylindrical. The structure is preferably sufficiently strong to push snow without additional supports. The scrapers may be adjustably attached to the body member or the side plates. The apparatus can have a bracket attached to an outer wall of the body member for attaching the snow removal apparatus to a vehicle.

BRIEF DESCRIPTION OF THE DRAWINGS

The above-mentioned and other features and advantages of this invention, and the manner of attaining them, will become appreciated and be more readily understood by reference to the following detailed description of one embodiment of the invention in conjunction with the accompanying drawings, wherein.

DETAILED DESCRIPTION

Figure 1:
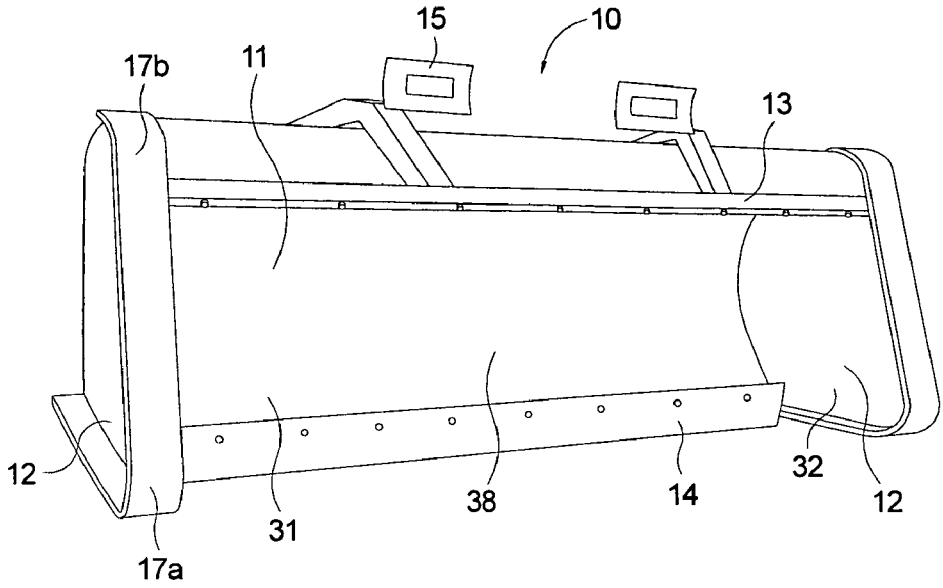
FIG. 1 is a front view of a first embodiment of a snow moving apparatus embodying the present invention.

Referring to FIG. 1, a front view of the snow moving apparatus 10 of the present invention is shown. The snow moving apparatus 10 comprises a single concave body member 11 having an inner wall 31 wherein said single concave body member comprises a pushing scraper 14 and a pulling scraper 13 attached thereto by any means known in the art. Preferably the attachment is such that snow cannot pass between the scrapers 13 and 14 and the body member 11. The scrapers 13 and 14 may be integral with the body member 11. The device further comprises a pair of side plates 12 fixedly attached to opposing sides of the concave body 11. The scrapers 13 and 14 are preferably adjustably attached to the side plates 12 and to the body member 11. Inner walls 32 of the side plates 12 and the inner wall 21 of the body 11 form a cavity 38 which is impermeable to snow. The side plates 12 and the body member 11 form a solid barrier around snow being pulled. The body member 11 is substantially semi-cylindrical. This shape gives the apparatus sufficient strength to push or pull large amounts of snow and contain the snow within the cavity 38 without the need to add supports to the side plates 12. Even very large embodiments of the invention can function well without additional supports. The device can be 4 to 26 feet long and 2 to 8 feet tall for example. The semi-cylindrical body 11 also enables large amounts of snow to be pushed or pulled without the snow falling between parts of the apparatus.

Additionally, each of said opposing side plates 12 further comprise a pair of skid plates 17*a* and 17*b*. When in various modes of operation the skid plates 17*a* and 17*b* are in communication with the ground and serve to assist the snow moving apparatus in movement along various types and conditions of terrain. In snow pushing mode, when the pushing scraper 14 is in communication with the ground, the skid plates 17*a* of side plates 12 are also in communication with the ground. In snow pulling mode, when the pulling scraper 13 is in communication with the ground, the skid plates 17*b* of side plates 12 are also in communication with the ground. Furthermore, FIG. 1 further illustrates a pair of brackets 15 suitable for attaching said snow moving apparatus to a vehicle.

Figure 2:
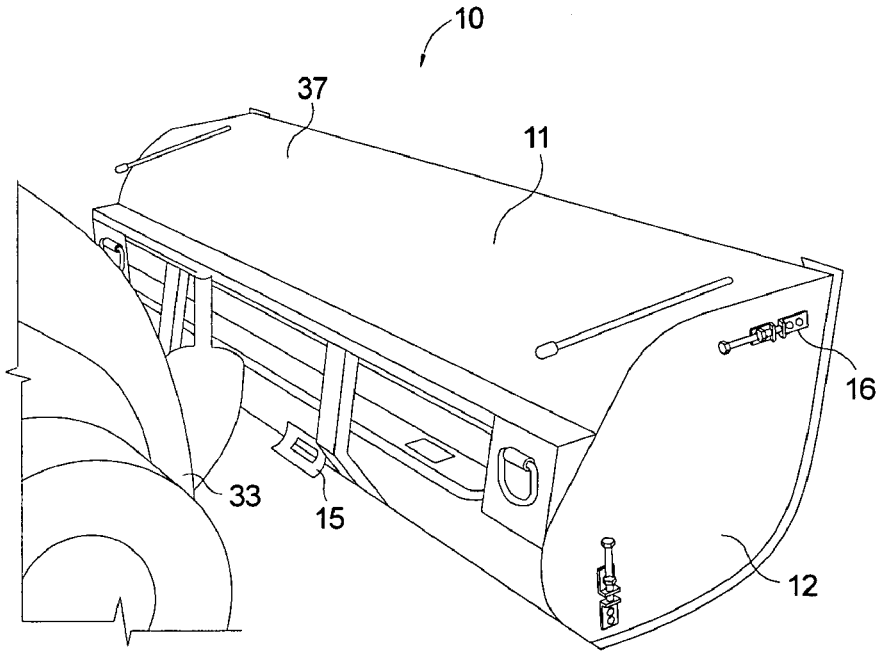
FIG. 2 is a rear view of the snow moving apparatus of FIG. 1 in pushing mode.

Referring now to FIG. 2 a rear view of the snow moving apparatus 10 of the present invention is shown. The snow moving apparatus 10 is attached to vehicle 33 via brackets 15 of said snow moving apparatus 10. It should further be noted that the vehicle further comprises a hydraulic device for orienting the snow moving apparatus between pulling mode and pushing mode. While a hydraulic device is disclosed above, it should be noted that any means for orienting the snow moving apparatus 10 between pushing mode and pulling mode may be used. Furthermore, the illustration shows the snow moving apparatus 10 oriented for pushing snow.

Figure 3:
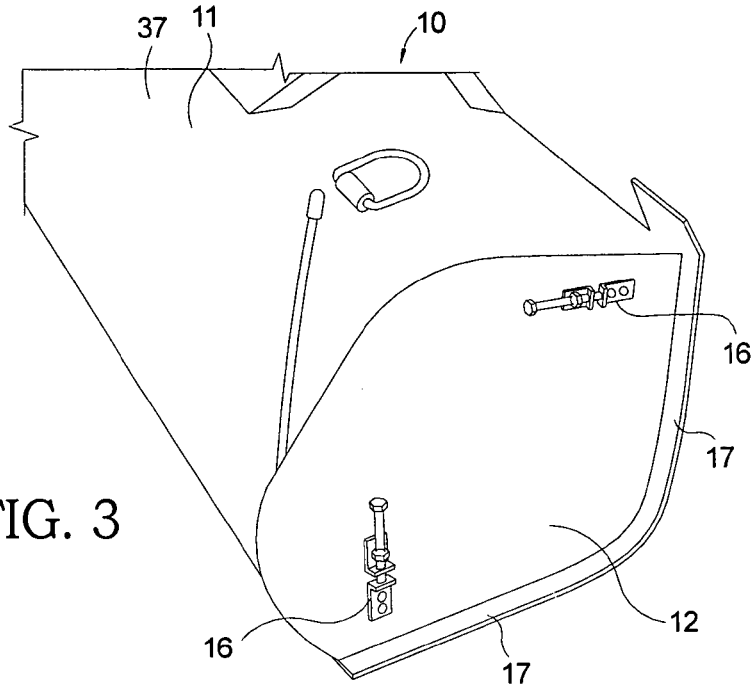
FIG. 3 is a side view of the snow moving apparatus of FIG. 1 in pulling mode.

Referring to FIG. 3, the illustration shows the snow moving apparatus of the present invent in snow pulling mode. More particularly, skid plate 17*b* of side plate 12, and the pulling scraper 13 are in communication with the ground.

Figure 4A:
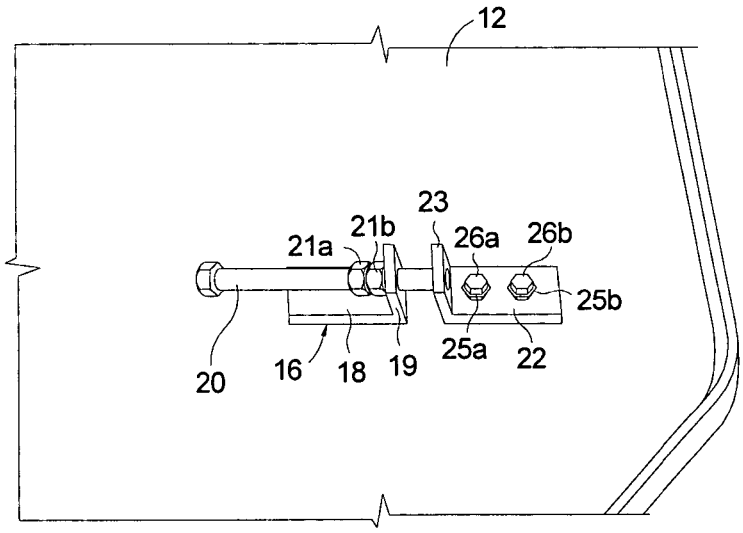
FIG. 4*a* is a partial side view of the snow moving apparatus of FIG. 1.
Figure 4B:
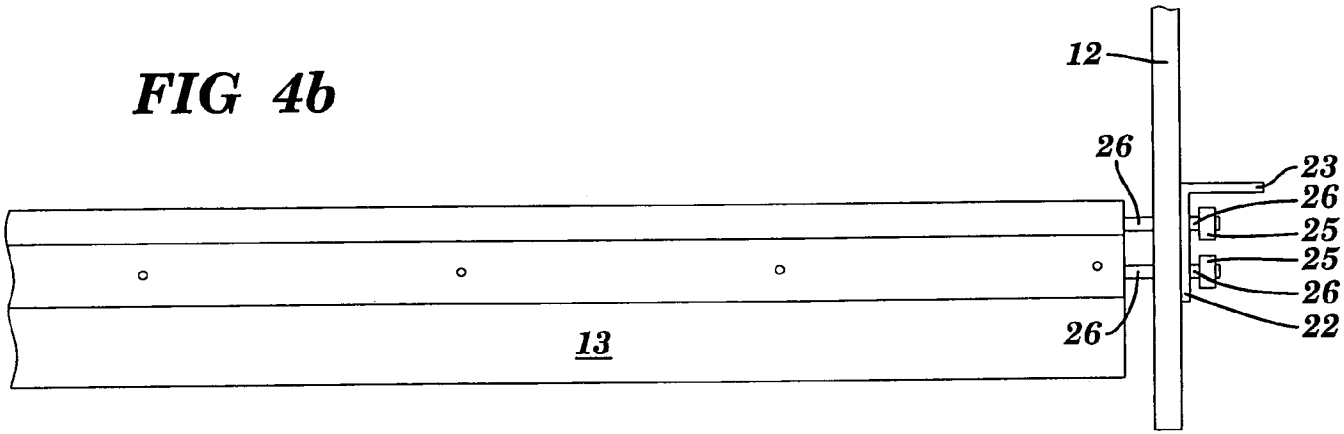
FIG. 4*b* is a detailed side view of the scraper adjustment means of the snow moving apparatus of FIG. 1.
Figure 4C:
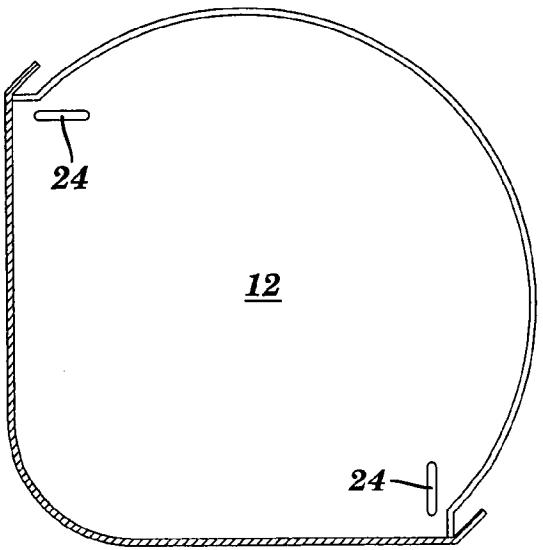
FIG. 4*c* is a side view of the snow moving apparatus of FIG. 1 without the scraper and scraper adjustment means.

Referring now to FIGS. 4*a*-4*c* a scraper adjustment means 16 is shown in detail. Slots 24 in the side plates 12 can be provided to accommodate the scraper adjustment means 16. The adjustment means comprises a stationary bracket portion 18 and an adjustable bracket portion 22. The stationary bracket portion 18 is fixedly attached to the side plate 12. While in a particular embodiment of the present invention the stationary bracket portion is welded to the side plates 12, any suitable means for fixedly attaching said stationary bracket portion 18 to said side plate 12 may be used. The stationary bracket portion 18 further comprises a base section 19 having a threaded bore (not shown). The base section 19 of the stationary bracket portion 18 projects outward, substantially perpendicular to the side plate 12. Furthermore, the threaded bore of the stationary bracket portion 18 is adapted to receive an adjustment bolt 20 and locking nuts 21*a* and 21*b*. The adjustable bracket portion 22 comprises an upper lip 23, wherein said upper lip protrudes outward, substantially perpendicular to the side plate 12. The adjustable bracket portion 22 further comprises a pair of bores (not shown) for receiving threaded rods 26. Additionally, the device further comprises a pair of adjustable bracket portion threaded nuts 25 for attaching to said pair of threaded rods 26.

Referring now to FIG. 4*b*, a detailed side view of the scraper adjustment means 16 and scraper 13 is shown. Generally, the pair of threaded rods 26 extend outward from each side of said scraper 13. Although only one side is shown in detail, it is understood that the side not illustrated is substantially similar to the illustrated side. Each pair of threaded rods 26 extend outward through a respective slot 24 in a respective side plate 12, and also pass through the corresponding bores (not shown) in the adjustable bracket portion 22. When the scraper is in the secure position the pair of adjustable bracket portion threaded nuts 25 are tightened, thereby serving to secure the adjustable bracket portion 22 and scraper 13 to the side plate 12. When adjustment is desired, the pair of adjustable bracket portion threaded nuts 25 is loosened on both sides of the snow moving apparatus, thereby freeing the scraper 13 to freely move within the slots 24. The scraper 13 is further adjusted by loosening the locking nuts 21*a* and 21*b* on adjustment bolt 20, and advancing the adjustment bolt 20 against the upper lip 23 of the adjustable bracket portion 22 until the scraper 13 is in the desired location. The scraper 13 is then secured in the desired position by tightening the adjustable bracket portion threaded nuts 25 and the locking nuts 21*a* and 21*b* on adjustment bolt 20. Additionally the adjustment bolt 20 provides an additional means of assuring that the scraper 13 does not move up in the slots 24, should the threaded nuts 25 come loose. The scraper 14 can be adjusted in a similar manner. Although this particular scraper adjustment means is disclosed, any adjustment means may be used.

It is understood that for embodiments of the invention that do not utilize a scraper adjustment means the scrapers 13 and 14 may be attached directly to the body 11 or side plates 12 via bolts, welding or any suitable means.

Figure 5:
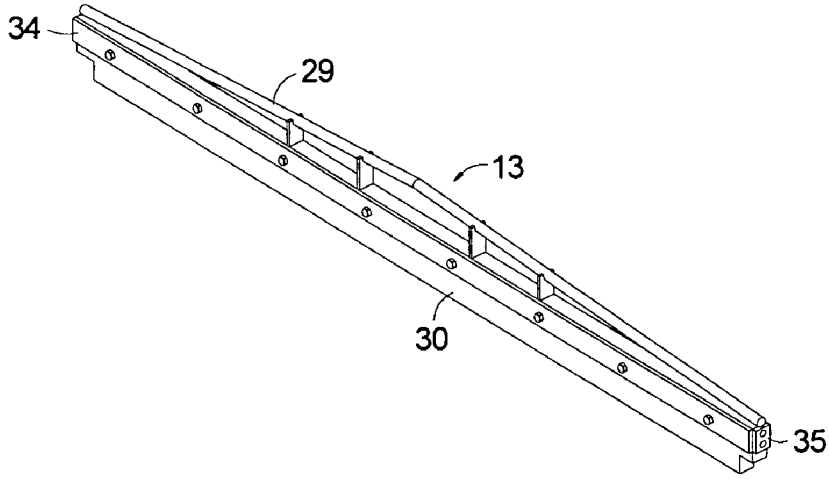
FIG. 5 is a perspective view of a scraper of the first embodiment of the present invention.

FIG. 5 illustrates a preferred scraper 13 that may be used in the invention. The scraper 13 comprises a truss 29 and a rubber blade 30. The truss 29 is attached to a split retaining plate 34 by any means known in the art. The rubber blade 30 is placed between the two sides of the retaining plate 34 and bolted in place. The scraper 13 can have a bracket 35 for accommodating the pair of threaded rods 26. The scraper 13 can be adjustably attached to the body member 11 via a tongue and groove attachment or any other attachment means known in the art. The truss 29 prevents the blade 30 from bowing but it is not necessary in all of the embodiments of the invention. The blade preferably is about 3 inches long. As the blade 30 wears down through use, the scraper 13 can be adjusted via the scraper adjustment means 16 so that it is sufficiently close to the ground. The scraper adjustment means enables the level of the blade 30 to be adjusted in about five minutes.

Figure 6:
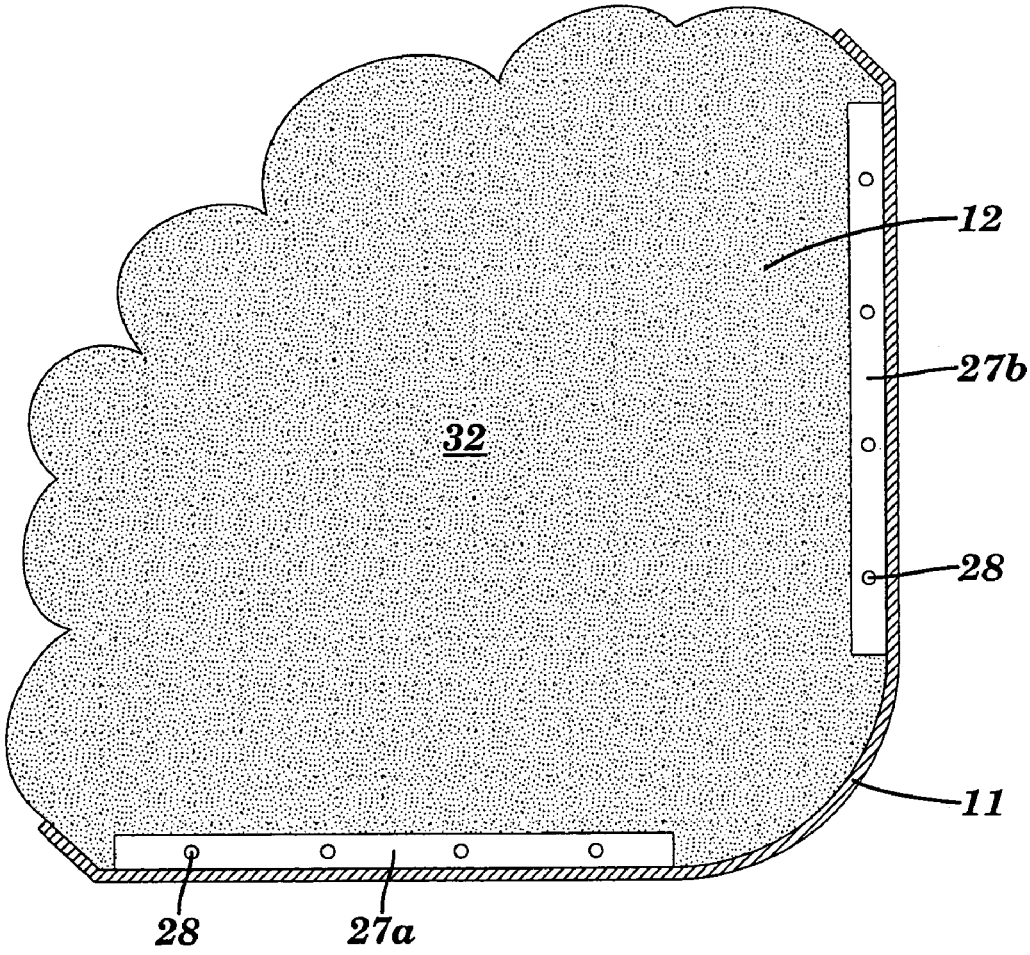
FIG. 6 is a partial side view of a side plate having angle irons adapted to receive removable skid plates.
Figure 7:
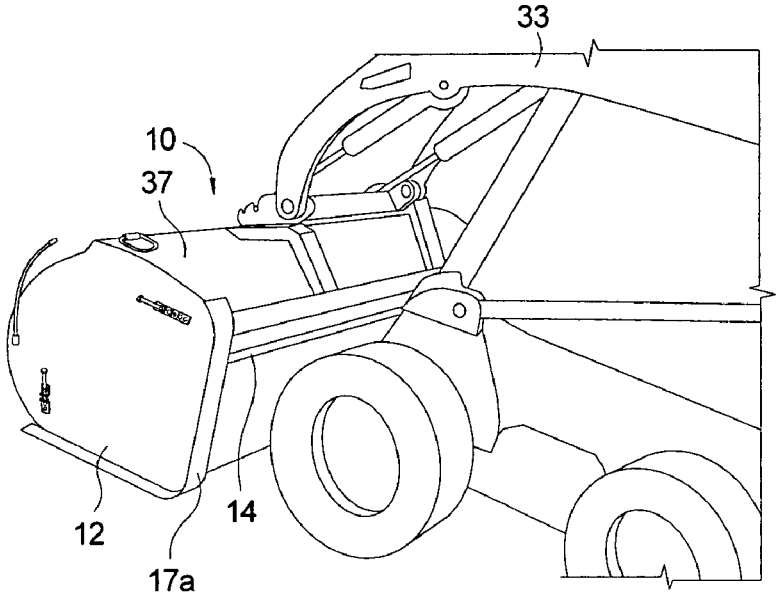
FIG. 7 is a side view of the snow moving apparatus of FIG. 1 in operation in pull mode.
Figure 8:
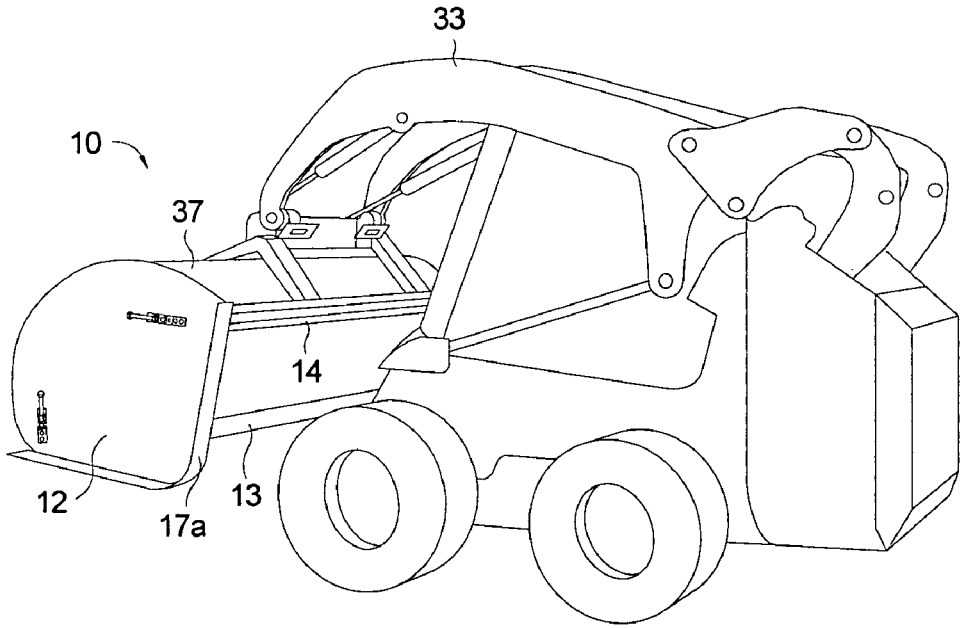
FIG. 8 is a side view of the snow moving apparatus of FIG. 1 carrying snow.

Furthermore, an additional embodiment of the present invention is contemplated wherein the skid plates 17 may be easily removed and replaced as needed. Referring now to FIG. 6, a side view of the side plate 12 of the snow moving apparatus, adapted to receive removable skid plates is shown. The apparatus further comprises a first angle iron 27*a* and a second angle iron 27*b*, fixedly attached to the inner wall 32 of the side plate 12. The angle irons 27*a* and 27*b* may be attached to the inner wall 32 of the side plate 12 by welding, or any suitable means. The angle irons 27*a* and 27*b* further comprise a plurality of holes 28, wherein said holes 28 are adapted to receive a bolt (not shown). Additionally, the removable skid plates (not shown) have a plurality of holes that align with the holes 28 on angle irons 27*a* and 27*b*. In operation, when the holes 28 on the angle irons 27*a* and 27*b* are aligned with the holes in the skid plates, the skid plates are attached to angle iron by bolts, or any suitable means. When the skid plates require replacement, the bolts provide a means for quickly removing and attaching the skid plates. In an alternative embodiment, a larger single angle iron can be used instead of two separate angle irons. The angle iron is preferably comprised of ½ inch steel, 4 inches wide.

The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting.

Although the present invention has been described in considerable detail with reference to certain preferred versions thereof, other versions are possible. For example, the scraper does not need to be attached to the body. Therefore, the spirit and scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" for "step" clause as specified in 35 U.S.C. § 112.

We claim:

1. An improved snow removal apparatus comprising:

a body member having an inner wall;

a pair of side plates attached to said body member, wherein said pair of side plates and said inner wall of said body member serve to form an inner cavity;

a first scraper adjustably attached to the side plates, and adapted for engaging the ground when pushing snow; and a second scraper adjustably attached to the side plates, and adapted for engaging the ground when pulling snow.

* * * * *